United States Patent [19]

Boursaw

[11] 4,051,609

[45] Oct. 4, 1977

[54] METHOD OF MAKING REUSABLE WRITING BOARD AND THE PRODUCT THEREOF

[76] Inventor: Thomas P. Boursaw, 703 W. Victoria Ave., Arlington Heights, Ill. 60005

[21] Appl. No.: 708,276

[22] Filed: July 23, 1976

[51] Int. Cl.[2] ..... B43L 1/12

[52] U.S. Cl. ..... 35/66; 35/62; 281/30

[58] Field of Search ..... 35/61, 66, 62; 281/30

[56] References Cited

U.S. PATENT DOCUMENTS

| | | | |
|---|---|---|---|
| 1,904,572 | 4/1933 | Trussell | 281/30 X |
| 2,606,041 | 8/1952 | Misiak | 281/30 |
| 2,818,662 | 1/1958 | Payne | 35/66 |
| 3,435,543 | 4/1969 | Slemmons | 35/61 |
| 3,943,643 | 3/1976 | Fisher | 35/66 |

*Primary Examiner*—Harland S. Skogquist

*Attorney, Agent, or Firm*—Darbo, Robertson & Vandenburgh

[57] ABSTRACT

A reusable writing board of "slate board" is both improved and of lower cost, avoiding use of the usual separate black-cardboard piece stapled to a backing. In a single printing operation, which is needed for face-printing anyway, the "slate" or background surface is provided on the same piece of paperboard. After further machine steps, a final operation of gluing and folding produces the finished slate board with a decoratively-printed head panel glued to extend down protectively over the top edge of the plastic work sheet covering the printed background. If desired, educational or informative discs can be rotatably secured under the head fold. Also, if desired, an air pocket can be formed under the head fold such that after writing by impressions through the work sheet, a sudden slap on the cover of the air pocket will raise the work sheet pneumatically to erase the writing.

16 Claims, 11 Drawing Figures

6-COLOR PRINTING PRESS
DIE CUTTING MACHINE
PATTERN WAX MACHINE
WINDOW-PATCHING MACHINE
GLUER AND FOLDER

[PRINTED HEAD PANEL]
[OPTIONALLY-PRINTED BACK FACE]
[PRINTED SLATE PANEL SOLID OR DESIGNED]
[WAXED SLATE PANEL]
PRESS-SIZED SHEET
DIE CUT PRINTED BLANK
SAME-WAX-COATED
SAME-COVER-FILM GLUED

METHOD OF MAKING REUSABLE WRITING BOARD AND THE PRODUCT THEREOF

The invention of which the present disclosure is offered for public dissemination in the event that adequate patent protection is available relates to the resuable writing boards commonly known as "slate boards" or "magic slates". These are the more modern replacements for the old child's slate boards on which chalk was used, perhaps originally on true slate. The modern replacements use a plastic sheet having a whitish-appearing undersurface laid over a solid black waxy surface so that writing with a stylus on the plastic sheet causes clinging to the waxy surface, thereby showing the writing as black on the whitish background. The writing may remain visible until the plastic sheet is lifted from the waxy surface, erasing the writing which had until then been visible.

Such pressure-sensitive writing boards have been known for many years and have commonly been made by stapling to a relatively heavy cardboard backing board both the pressure-tacky black panel and its covering work sheet. Sometimes there were two covering sheets, a whitish pressure-responsive sheet and a transparent protective sheet. Many millions of pressure-sensitive reusable writing boards have been made and sold. The long-used stapling of a separate piece has its drawbacks. Stapling is a relatively expensive operation compared to other methods of paper product manufacture. Also, the cover sheets too easily tear off at the staples. The facts as to these drawbacks have been well known in the trade for many years. Some efforts to reduce the tear-off problem have been adopted, such as folding and gluing a binding strip over the top edge of the tacky-board and cover sheet assembly before stapling. Although this has reduced the tearing propensities, it has not cured them, and of course it represented some additional cost beyond the already high stapling cost. The present invention gives better tear-resistance by gluing the secured edge of the covering sheet and protecting it by folding down over it a relatively tough cardboard head-flap. This is accomplished at lower cost than prior manufacturing costs by avoiding stapling and avoiding the costs of a separate waxy-board piece. Instead, the waxy impression area and backing sheet are all the same piece, the solid black (or some more desirable surfacing) of the waxy board being produced by the same printing operation in which all other printed matter on the board is printed; and other manufacturing steps (including wax coating, gluing and spotting the cover sheet, and gluing and folding the blank thus formed to provide the finished product) are machine operations which can be performed at very low cost. Instead of having a back board of adequate stiffness with an added waxy board, the folding and gluing produces adequate stiffness from a paperboard stock thinner than the prior backing boards, with no separate tacky board needed. Some efforts at printing the background have not produced satisfactory results. Printing on a clay-coated surface of sulfate or Kraft paper, instead of the more usual chipboard, has solved the problem and given improved "slate" characteristics.

There has been a previous proposal (U.S. Pat. No. 1,631,192) for protecting the cover sheets by folding over a flap from the backing board at the top of the writing pad. However, this did not save the cost of stapling because the securing means still comprised fastening members, in this instance eyelets or metal clips.

Advantages of the invention, which lends itself to various optional features, will become more apparent in the light of the following description and of the drawings.

DESIGNATION OF FIGURES

Figures 5, 6, 7, 8, 9, 10:
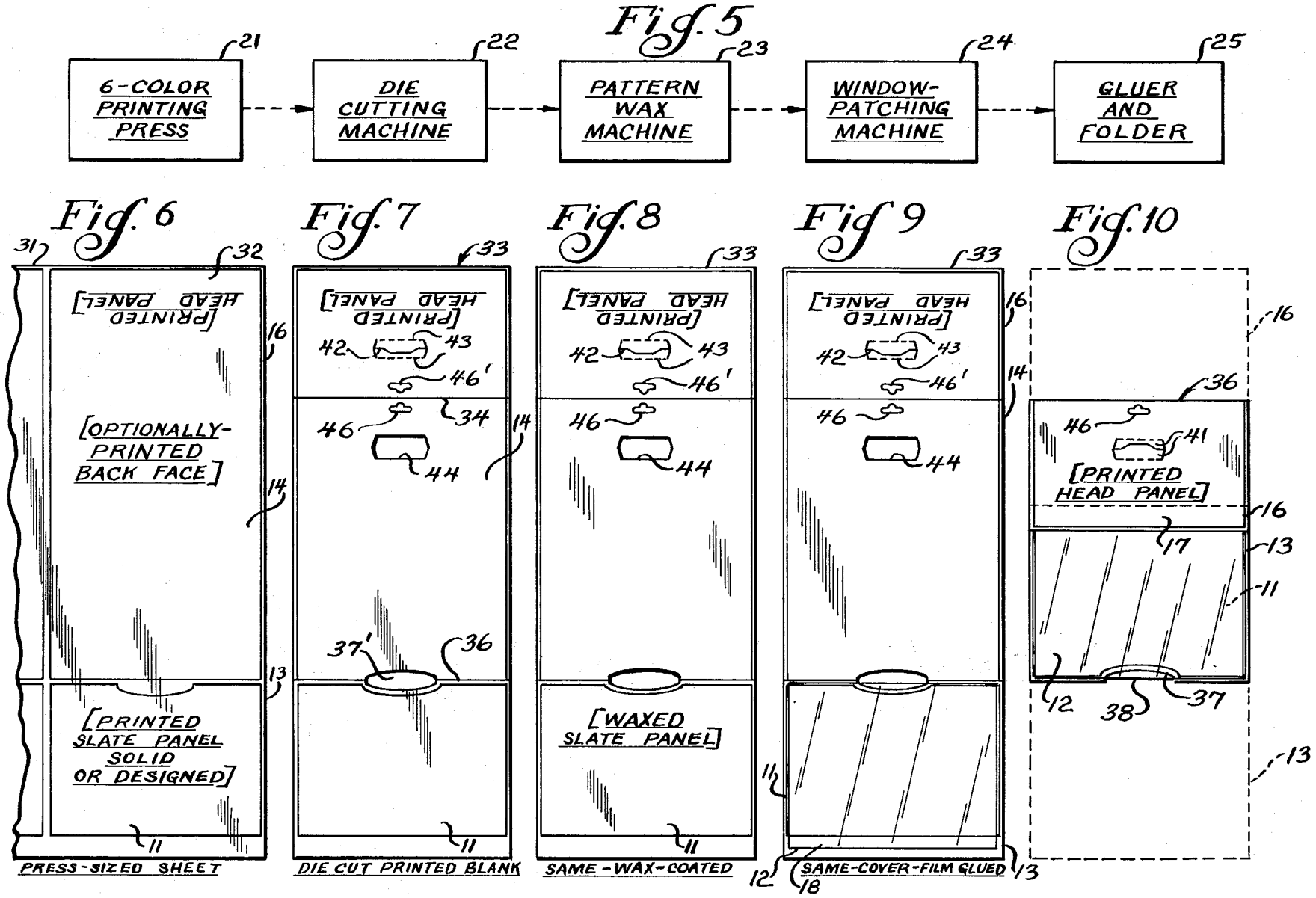
FIG. 5 is a flow diagram indicating the various machines and manufacturing steps used in the production of the pressure-sensitive writing boards of this invention, some additional steps being required if the instructional discs of FIG. 2 are to be provided.

FIGS. 6 to 10 are positioned below the respective machines shown in FIG. 5 to show each machine the product or intermediate product which is an output of that machine. Thus FIG. 6 illustrates the result of the first manufacturing step, in which a large press-sized sheet has been printed to produce a plurality of writing boards. FIG. 7 represents the product of the next step of manufacture, a die cut blank with scored lines for folds. FIG. 8 represents the third step of manufacture, in which wax has been applied to or printed on the printed "slate" panel to provide a pressure-tacky surface. FIG. 9 represents the product of the fourth step of manufacture in which the cover film has been applied over the slate panel, with gluing along one edge, by a window patching machine. FIG. 10 represents the finished product, with dotted lines showing the former positions of the panels which have been folded by the gluer and folder.

General Description of Invention

The embodiments of this invention superficially resemble reusable pressure-sensitive writing boards, often called "magic slates", as these have been known for many years. Thus these embodiments include a pressure-tacky background 11 which in the past has conventionally been solid black and wax coated, overlaid by a cover sheet 12 which hides the background 11 except where impressed with a writing instrument such as a stylus. The pressure of the stylus makes the undersurface of the cover sheet means 12 cling to the background 11, which becomes visible where the clinging occurs. Thus the writing by the stylus remains visible. Conventionally the appearance has been that of black writing on a whitish background. The whitish background may result from surface characteristics of the back of the sheet 12 as illustrated, or the cover sheet means may have included a second or lower sheet, in which latter case the top sheet was more completely transparent. The writing can be instantly erased by lifting from the background 11 the sheet clinging to it so that the clinging areas are separated.

According to general practice heretofore, the background 11 was provided by the separate sheet of paperboard stock, the front face of which was coated with wax. One feature of the present invention is in avoiding this separate background sheet. Instead, the background 11 is borne by a flap 13 folded from back portion 14 which, at its opposite edge, has a second folded flap 16. The flaps 13 and 16 are both glued to the back portion 14 to bring desired rigidity to the total structure.

According to another feature of the invention, an edge portion 17 of the flap 16 overlies the securing area 18 for the cover sheet 12, which has preferably been secured before the folding operation by gluing to the flap 13. Thus portion 17 hides the unsightly glue as well as protecting the cover sheet 12. Heretofore, the cover sheet means 12 and the separate background piece have usually been secured to a backing board by fasteners such as staples. Not only has this been a relatively expensive operation, but also it has usually resulted in a propensity for tearing the cover sheets. A torn cover sheet in the store of course makes the product unsaleable, and a torn cover sheet after purchase makes the customer unhappy.

An advantage of the construction so far described is that it lends itself to very economical manufacture, inasmuch as the various steps can be performed very efficiently by machinery. Indeed, the method of operation and type of construction which lend themselves to manufacture by machinery might be considered the major feature of the invention.

Figure 2:
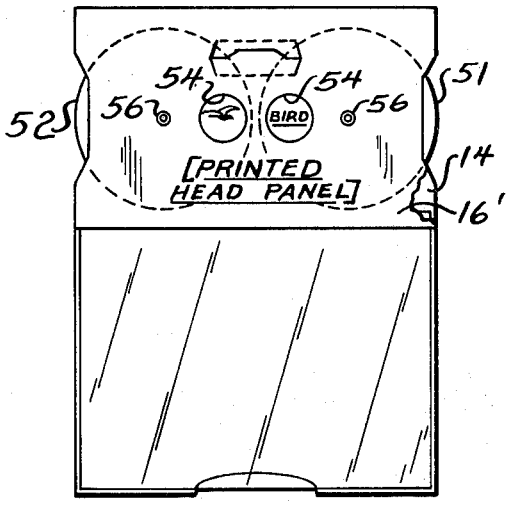
FIG. 2 is a view of a form of the present invention similar to FIG. 1 but including the optional features of instructional or informational discs between the folds, which may be rotated to expose selected printed matter on the discs through the windows.
Figure 3A:
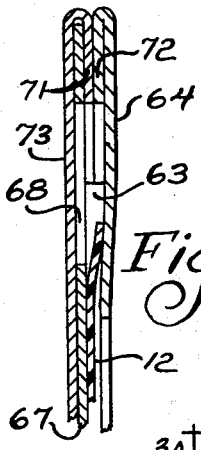
FIGS. 3 and 3A are face and fragmentary enlarged sectional views of a form of the invention in which erasure can be accomplished pneumatically by slapping a portion of the head panel covering an air pocket.
Figure 3:
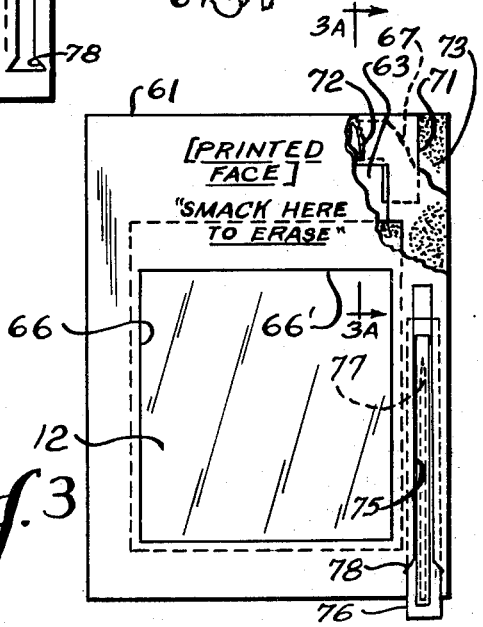

One advantage of the general construction described and of its method of operation is in making practicable other improved versions of the reusable pressure-sensitive writing boards, such as those illustrated in FIGS. 2 and 3 which can perhaps be understood better after a more detailed description of the method of manufacture.

METHOD OF MANUFACTURE

Figure 1:
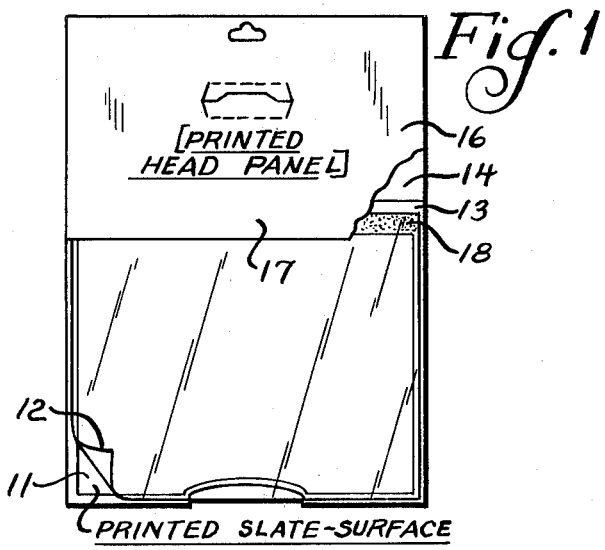
FIG. 1 is a face view, with portions broken away, of a relatively simple form of the present invention.

FIG. 5 may be regarded as a flow diagram for the successive steps of manufacture in producing the basic form of the invention shown in FIG. 1, and with some variations the forms shown in FIGS. 2 and 3. Boxes 21 to 25 of FIG. 5 represent successive machines which need no further illustration because their nature and general construction is already well known. The present mode of manufacture contemplates using the various machines 21 to 25 in separate operations with automatic feeding from a stack and delivery to a stack in each instance. A pallet on which the discharge from one machine is stacked would be moved by a lift truck to the feeding position of the next machine.

As indicated in FIG. 6, the preferred first step of manufacture is the printing of a sheet 31 preferably large enough to form several reusable writing boards. Naturally, greatest economy is achieved by printing as many writing boards on one sheet as can be produced by the printing press available, and in this sense the sheet to be used is a press-sized sheet. For each writing board which is to be cut from the sheet, the printing will usually comprise the background 11 on a portion 13 (ultimately to be folded flap 13) extending from the back portion 14. Almost always there will also be decorative or commercial printed matter or face-printing in another area 32 on a portion 16 extending in another direction from the back portion 14. The back portion 14 may optionally be printed, also. The back printing may be merely the name of the distributor. For some purposes, however, it might be desirable to print a great deal of informational matter on this face of the back 14 which will ultimately be available to the user by turning the writing board over.

After the printing of a stack of the press-sized sheets, such as seen in FIG. 6, the press-sized sheets will be fed from the stack in succession to a die-cutting machine 22 from which a typical output is seen in FIG. 7. Ignoring for the moment some details relating to refinements, the die-cutting machine 22 will cut separate blanks 33 from the press-sized sheet 31, and will score fold lines 34 and 36, i.e., cut partly through.

Next, the blanks 33 will be fed from a stack through a pattern wax machine 23, which will apply a coating of wax to the background 11. The pattern wax machine functions essentially as a printing press, applying the wax to a selected area by application of a wax-wetted heated plate.

The blanks are now fed from their new pile through a window-patching machine 24 which applies the plastic-film cover sheet 12 over the printed background 11, adhering it to the portion 18 of the blank 33. The adhesive may be applied during this operation to the portion 18 of the blank 33 or to the plastic film. Alternatively, the adhesive may be a pressure-sensitive adhesive previously applied to the plastic film.

From the new pile of blanks 33 discharged from window-patching machine 24, the blanks are fed, printed side down, through a gluer and folder 25. After the glue is applied, the folder portion of the gluer and folder folds first the portion 13 upwardly and down into adhesion with the backing portion 14, and then the portion 16 upwardly and downwardly into adhesion with the backing portion 14. The output of the gluer and folder 25 is the finished reusable writing board shown in full lines in FIG. 10.

REFINEMENTS

A refinement which has commonly been provided is a lift opening 37 in the bottom of the writing board. This lift opening 37 is overhung by the bottom edge 38 of the cover sheet 12 so that the user can easily grasp the cover sheet 12 by its edge portion 38 to lift it for erasure. The lift opening 38 which appears semi-oval in FIG. 10, is formed by cutting an oval opening 37' as shown in FIG. 7 as the blank 33 passes through the die-cutting machine 22. The score line 36 bisects this opening 37' so that upon folding there will be a semi-oval opening 37.

It is also expected that stylus-holding flaps 41 will be provided in most reusable writing boards. Again, this is accomplished by the die-cutting machine 22 which, as seen in FIG. 7, cuts along a flap forming line 42, and scores along the lines 43. An aperture 44 is cut by the die-cutting machine 22 in the back portion 14 positioned to underlie the flaps 41 after the folding operation so that a finger can be pressed through aperture 44 to spring the flaps 41 upwardly on first use sufficiently to insert the stylus under them. When the reusable writing boards are to be sold at retail, it will usually be desirable to discourage use of the stylus until after purchase by placing it under a seal. To this end a sealing membrane may be sealed over the stylus after it has been inserted in the flaps 41, or a separate packet can be formed for the stylus and from which removal of the stylus is difficult.

One way to form the separate packet is to provide some extra length of cover sheet 12 above where it is now shown, and a slot in flap 16 into which the sheet 12 can be humped to enclose the stylus, similar to blister packing.

Another refinement which retailers will often desire is to provide a hanging slot 46 as seen in FIG. 10. This is again accomplished on the die-cutting machine 22 by providing two matching slots 46' which are cut by the die-cutting machine 22.

The die-cutting machine 22 is preferably equipped with slug ejection means for knocking out the slugs left by cutting the oval 37', the aperture and the matched apertures 46'.

Although the glue could be applied to the backing portion 14, it will probably usually be preferred to apply the glue instead throughout the back faces of the flaps 13 and 16. This will have the advantage that the protective portion 17 of the flaps 16 which overlies the cover sheet 12 will be glued down. Not only does this help hold cover sheet 12, but it also presents less of a temptation to the user as a handle for destructively pulling up the flap 16.

ROTATIVE DISC VERSION

The folded nature of the writing boards of the present invention is readily adaptable to other modifications. For example, as seen in FIG. 2, a pair of rotative discs 51 and 52 may be pivotally mounted between the backing 14 and the head panel flap 16' with suitable windows such as windows 53 and 54 provided for viewing selected portions of the discs 51 and 52. Of course, in this event glue would be omitted in the area of the discs 51 and 52, so that they will be free to turn. The discs may be pivoted on eyelets 56 which may extend through both back portion 14 and flap 16'. For manufacturing convenience it may be found preferable to have the eyelets extend through only the disc and either backing 14 or top flap 16' so that prior to folding and gluing, the discs may be spotted automatically, and the eyelets applied before any displacement of the discs can occur.

PNEUMATIC ERASING VERSION

Figure 4:
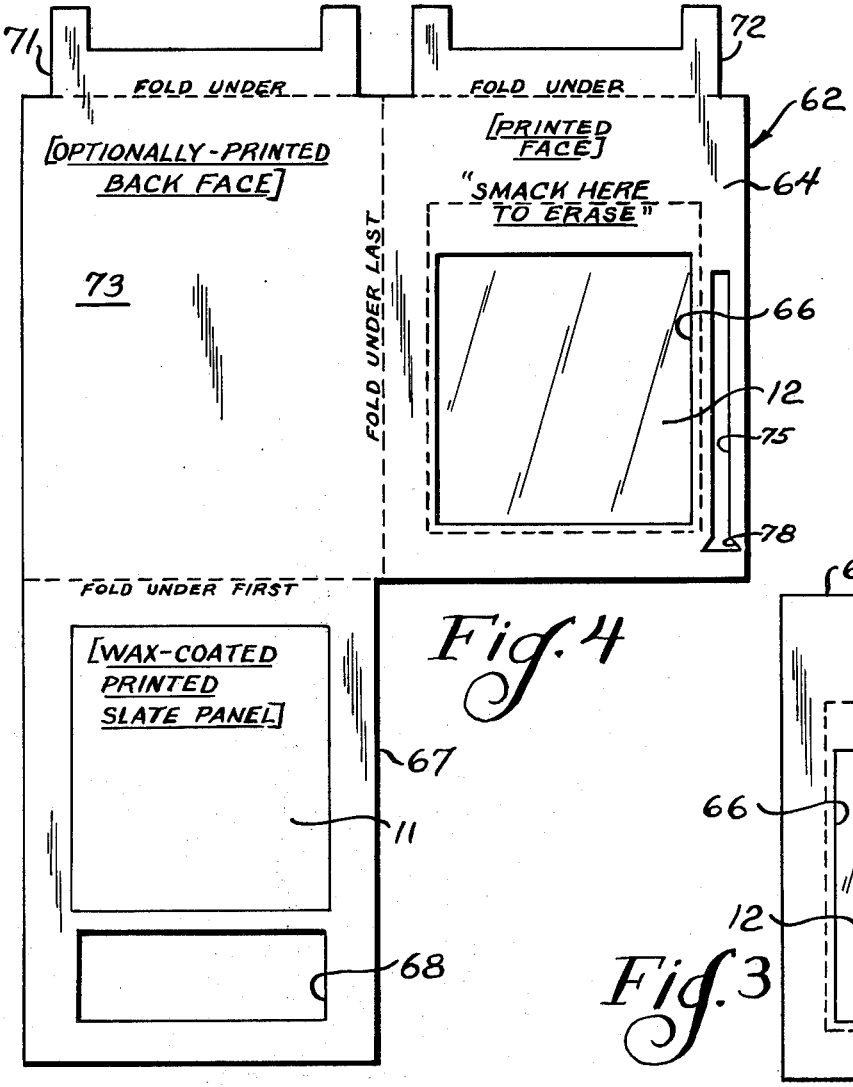
FIG. 4 is a view of the printed and die cut blank ready for the gluing and folding operation to produce the pressure-sensitive writing board of FIG. 3.

There has already been a proposal, U.S. Pat. No. 3,943,643, issued on an application of Fisher and Scott, to accomplish the erasing lift of the cover sheet pneumatically, or by an air blast. The method of the present invention lends itself to a variation in which a pneumatically erasable reusable writing pad can be made at low cost, and with superior dependability in accomplishing the erasing. A writing board 61 exemplifying this version of the invention has been shown in FIG. 3, and the blank 62 which is folded and glued to produce the writing board 61 is shown in FIG. 4. The blank 62 folds to provide an air pocket 63 which preferably holds a substantial body of air by virtue of having a thickness of several layers of the paperboard from which the blank 62 is made. It will be observed that the blank 62 has, in accordance with the present invention, been printed on one face only to provide both the wax coated background area 11 and the face-printing, which in this case is on flap 64 and includes not only such commercial and decorative matter as may be desired but also some such instruction and the words "SMACK HERE TO ERASE" seen in FIGS. 3 and 4. In this instance, the panel 64 is not merely a head panel but will extend throughout the face of the finished writing board 61 as shown in FIG. 3, except where a window has been provided as indicated by the rectangle 66, giving access to write on cover sheet 12.

The construction in FIG. 3 can probably best be understood by description of the blank 62 and the folding thereof. The folding instructions shown would not appear on the blanks, because machine folding is contemplated. Because FIG. 4 shows the blank 62 printed side up, the words "Fold under" have been used, although when passing through the gluer and folder the folds will actually be upward because the blanks will have been fed printed side down. Before folding the face flap 64, the background-bearing flap 67 will be folded so that in the finished product the flap 67 (and its background area 11) will lie under the cover sheet 12 secured under the window 66. In addition to the background area 11, the flap 67 has a cut-out or window area represented by the rectangle 68. After folding, the edges of this window outline the air pocket 63 of FIG. 3. In order to increase the thickness of this air pocket, flaps 71 and 72 are provided. After the folder has folded the flap 67 and pressed it against the back area 73, with the adhesion wherever glue had previously been applied, the flaps 71 and 72 will be folded, after which the flap 64 will be folded. In the completed reusable writing board, the air pocket 63 will have a thickness extending from the back portion 73 to the face portion 64. This thickness will include the thickness of the flaps 71 and 72 which lie between flap 67 and flap 64.

When the "SMACK HERE" area is sharply depressed by a smack of the user's hand, that portion of panel 64 will be sharply depressed toward backing 73, pumping a sudden blast of air under the cover sheet 12. The gluing preferably is such as to substantially prevent discharge of the air from pocket 63 except by passing under the cover sheet 12, regardless of whether it is trapped under it or can escape. To this end, all three panels 64, 67 and 73 should be glued together along the right and left margins thereof as viewed in FIG. 3. It appears not to be essential to glue the flaps 71 and 72 together because the natural resiliency of the material presses them against each other even if they are not glued together. This resiliency also tends to give the pocket 63 more thickness than the minimum which would result from the various layers.

It will be observed in FIG. 4 that the cover sheet 12 is glued to the face panel 64 (the unprinted face thereof) rather than to the panel 67 on which the background 11 is printed. Thus after gluing and folding (to the form shown in FIG. 3), the air squeezed out of pocket 63 is free to flow under the cover sheet 12, i.e., between it and the panel 67.

Because the top edge of cover sheet 12, where it is glued to panel 64, is held by panel 64 spaced well above the panel 67, it may be desirable to have the upper edge 66' of the window 66 located substantially below the adhered portion 73 at the top of the cover sheet 12, perhaps even further than is shown in FIG. 3. The reason for this is that with that degree of separation, the portion of the cover sheets 12 too close to the adhering point may not cling reliably to the background 11. By using the top edge 66' of the window to confine the writing to a safe distance from the raised and adhered areas 73, this minor problem is overcome.

The folded construction of the various forms of this invention lends itself to a further simplification when a separate stylus packet is used. By cutting a T slot 75 out of the cover flap 64 (or 16) and leaving the adjacent area unglued, a blistered plastic packet 76 with the stylus 77 in it on the underside can be slid through the head 78 of the T, with the blister fitting the leg of the T. Depending on whether the trailing flange of the packet drops into the slot or stays on top of flap 64, or can be sprung under flap 64, varying degrees of discouragement of pre-purchase removal are available.

In spite of leaving areas unglued where necessary for a sliding part (such as packet 76 or discs 51) or where needed for the pneumatic erasing, it is generally preferred to glue generally throughout, especially back of the writing area (background 11) for maximum stiffness.

ACHIEVEMENT

From the foregoing the present invention provides an interrelated method of manufacture and construction for reusable writing boards such that by this invention such boards can be made with both improved characteristics and lower cost. A major factor contributing to both is the printing of the background on paper stock suitable for printing while at the same time printing whatever face-printing is desired, the piece thus printed being ultimately folded to expose the printed background and the face-printing in proper relationship to be viewed at the face of the writing board. Furthermore, the cover sheet for the background is better protected from being inadvertently torn at its securing points than has been the case heretofore. This added resistance to tearing is a substantial improvement in the product. Also, the protection against tearing given to the cover sheet encourages the use of a cover sheet thinner than was usually considered necessary for adequate tear resistance. There seem to be other improvements, however. The better paperboard (clay coated on one face of Kraft stock) needed for best "slate" results is made economically possible by the economy of manufacture which it achieves. This results in higher quality printing throughout. It combines with the thin cover sheet to give better pressure-sensitive writing than is believed to have been commercially attained previously. The preferred cover sheet is film of 1.5 mils. thickness with a matte finish on its under surface.

The printing of the background 11 also permits many variations of printing. Various colors instead of black can be used, and with a multicolor offset press, an infinite range of colors can be printed at one time by "process" printing. In one run, some boards may be printed in one "solid" color, others in other colors. In this event, the "solid" color may be the multitude of dots which in halftone printing appear solid to the eye. Ruling or other designs can be used on the background, the cover sheet 12 preferably being so nearly transparent that these can be seen through this sheet even though it gives plenty of contrast between inscribed and adjacent areas.

In addition, the method of manufacture and type of construction are easily adapted to various other improvements such as the inclusion of rotatable discs for information or education, and the provision of an improved penumatic erasing feature.

I claim:

1. A reusable pressure-sensitive writing board of the type having cover sheet means overlying a background, initially loosely, adapted to cling to the background where impressed thereon and to then show, until reloosened, a contrast between the clinging area and the nonclinging area, characterized by being formed, except for its cover sheet means, essentially from a single sheet of cardboard folded and including a back portion, a flap folded forwardly therefrom and down thereover and including on the forward face thereof a printed background with a pressure-tacky surface; and including a second flap folded forwardly from the same back portion and adhered down thereover, with face-printing on its forward face and having an edge overlying the first flap to provide a protected area thereof; the cover sheet means being adhered to said cardboard under the said second flap.

2. A reusable pressure-sensitive writing board according to claim 1, in which a stylus-containing packet protrudes through a slot in the second flap from between said flap and the back portion.

3. A reusable pressure-sensitive writing board according to claim 1, in which intermediate flap means separates the back portion and second flap in selected areas, and in other areas leaves an air pocket between the back portion and the second flap, with communication selectively between said pocket and the space between the cover sheet and the pressure-tacky background so that sharply depressing the second flap into said pocket pneumatically lifts the cover sheet.

4. A method of making a pressure-sensitive reusable writing board of the type having cover sheet means overlying a background, initially loosely, adapted to cling to the background where impressed thereon and to then show, until loosened, a contrast between the clinging area and the nonclinging area, characterized by:

performing by machine a series of steps including:

a. printing on one face of a sheet of cardboard the background for the writing surface and in other areas such face-printing as is desired, providing a surface of the printed background adapted to cling as stated;

b. die cutting a blank from said cardboard with fold lines prepared for folding two flaps from a common back piece;

c. adhering a narrow portion of the cover sheet means to the cardboard in such position that the cover sheet means will lie over the background;

d. folding a flap of said sheet over and down with said background on the outside face of the flap to face toward the front face of the folded sheet;

e. folding a second flap, in the same direction, from a common base portion now forming the back, with face-printing exposed on this second flap; and adhering said second flap in folded-down position with an edge thereof extending over said narrow portion of the cover sheet.

5. A method of making a pressure-sensitive reusable writing board of the type having cover sheet means overlying a background, initially loosely, adapted to cling to the background where impressed thereon and to then show, until loosened, a contrast between the clinging area and the nonclinging area, characterized by:

performing by machine a series of steps including:

a. printing on one face of a sheet of cardboard the background for the writing surface and in other areas such face-printing as is desired, providing a surface of the printed background adapted to cling as stated;

b. die cutting a blank from said cardboard with fold lines prepared for folding two flaps from a common back piece and with flaps cut in one of said flaps for retaining a stylus, and an aperture cut in said back to lie behind said flaps after folding;

c. adhering a narrow portion of the cover sheet means to the carboard in such position that the cover sheet means will lie over the background;

d. folding a flap of said sheet over and down with said background on the outside face of the flap to face toward the front face of the folded sheet;

e. folding a second flap, in the same direction, from a common base portion now forming the back, with face-printing exposed on this second flap; and ahering said second flap in folded-down position with an edge thereof extending over said narrow portion of the cover sheet.

6. A method of making a pressure-sensitive reusable writing board of the type having cover sheet means overlying a background, initially loosely, adapted to cling to the background where impressed thereon and to then show, until loosened, a contrast between the clinging area and the nonclinging area, characterized by;

performing by machine a series of steps including:

a. printing on one face of a sheet of cardboard the background for the writing surface and in other areas such faceprinting as is desired, providing a surface of the printed background adapted to cling as stated;

b. die cutting a blank from said carboard with fold lines prepared for folding two flaps from a common back piece and with flaps cut in one of said flaps for retaining a stylus, and an aperture cut in said back to lie behind said flaps after folding, and with an aperture cut straddling a fold line to form a finger-admitting notch when folded;

c. adhering a narrow portion of the cover sheet means to the cardboard in such position that the cover sheet means will be over the background;

d. folding a flap of said sheet over and down with said background on the outside face of the flap to face toward the front face of the folded sheet;

e. folding a second flap, in the same direction, from a common base portion now forming the back, with face-printing exposed on this second flap; and adhering said second flap in folded-down position with an edge thereof extending over said narrow portion of the cover sheet.

7. A method of making a pressure-sensitive reusable writing board of the type having cover sheet means overlying a background, initially loosely, adapted to cling to the background where impressed thereof and to then show, until loosened, a contrast between the clinging area and the nonclinging area, characterized by:

performing by machine a series of steps including:

a. printing on one clay-coated face of a sheet of cardboard for background for the writing surface and in other areas such face-printing as is desired, providing a surface of the printed background adapted to cling as stated;

b. adhering a narrow portion of the cover sheet means to the cardboard in such position that the cover sheet means will lie over the background;

c. folding a flap of said sheet over and down with said background on the outside face of the flap to face toward the front face of the folded sheet;

d. folding a second flap, in the same direction, from a common base portion now forming the back, with face-printing exposed on this second flap; and adhering said second flap in folded-down position with an edge thereof extending over said narrow portion of the cover sheet.

8. A method of making a pressure-sensitive reusable writing board of the type having cover sheet means overlying a background, initially loosely, adapted to cling to the background where impressed thereon and to then show, until loosened, a contrast between the clinging area and the nonclinging area, characterized by:

performing by machine a series of steps including:

a. printing on one face of a sheet of cardboard the background for the writing surface and in other areas such faceprinting as is desired;

b. adhering a narrow portion of the cover sheet means to the cardboard in such position that the cover sheet means will lie over the background;

c. selectively applying a wax coating to the background;

d. folding a flap of said sheet over and down with said background on the outside face of the flap to face toward the front face of the folded sheet;

e. folding a second flap, in the same direction, from a common base portion now forming the back, with face-printing exposed on this second flap; and adhering said second flap in folded-down position with an edge thereof extending over said narrow portion of the cover sheet.

9. A reusable pressure-sensitive writing board of the type having cover sheet means overlying a background, initially loosely, adapted to cling to the background where impressed thereon and to then show, until reloosened, a contrast between the clinging area and the nonclinging area, characterized by being formed, except for its cover sheet means, essentially from a single sheet of cardboard folded and including a back portion, a flap folded forwardly therefrom and down thereover and including on the forward face thereof a clay-coated surface bearing a printed background with a pressure-tacky surface; and including a second flap folded forwardly from the same back portion and adhered down thereover, with face-printing on its forward face and having an edge overlying the first flap to provide a protected area thereof; the cover sheet means being adhered to said cardboard under the said second flap.

10. A reusable pressure-sensitive writing board of the type having cover sheet means overlying a background, initially loosely, adapted to cling to the background where impressed thereon and to then show, until reloosened, a contrast between the clinging area and the nonclinging area, characterized by being formed, except for its cover sheet means, essentially from a single sheet of cardboard folded and including a back portion, a flap folded forwardly therefrom and down thereover and including on the forward face thereof a printed background with a pressure-tacky surface, and having its rear face area adhered to the backing, generally throughout the writing area, for stiffness; and including a second flap folded forwardly from the same back portion and adhered down thereover, with face-printing on its forward face and having an edge overlying the first flap to provide a protected area thereof; the cover sheet means being adhered to said cardboard under the said second flap.

11. A reusable pressure-sensitive writing board according to claim 10, in which some area of the facing surfaces between the back portion and the second flap is left unadhered and an element is shiftably located between said facing surfaces.

12. A reusable pressure-sensitive writing board according to claim 10, in which a stylus-containing packet protrudes through a slot in the second flap from between said flap and the back portion, said slot being T-shaped to permit the packet to be inserted by sliding in through the head of the T.

13. A method of making a pressure-sensitive reusable writing board of the type having cover sheet means overlying a background, initially loosely, adapted to cling to the background where impressed thereon and to then show, until loosened, a contrast between the clinging area and the nonclinging area, characterized by printing on one face of a sheet of cardboard the background for the writing surface and in other areas such face-printing as is desired, providing a pressure-tacky surface for the printed background, adhering a narrow portion of the cover sheet means to the cardboard in such position that the cover sheet means will lie over the background; folding a flap of said sheet over and down with said background on the outside face of the flap toward the front face of the folded sheet; folding a second flap, in the same direction, from a common base portion now forming the back with face-printing thereon exposed, and adhering said second flap in folded-down position with an edge thereof extending over said narrow portion of the cover sheet means.

14. A method of making a pressure-sensitive reusable writing board of the type having cover sheet means overlying a background, initially loosely, adapted to cling to the background where impressed thereon and to then show, until loosened, a contrast between the clinging area and the nonclinging area, characterized by:

performing by machine a series of steps including:

a. printing on one face of a sheet of cardboard the background for the writing surface and in other areas such face-printing as is desired, providing a surface of the printed background adapted to cling as stated;

b. adhering a narrow portion of the cover sheet means to the cardboard in such position that the cover sheet means will lie over the background;

c. folding a flap of said sheet over and down with said background on the outside face of the flap to face toward the front face of the folded sheet;

d. folding a second flap, in the same direction, from a common base portion now forming the back, with face-printing exposed on this second flap; and adhering said second flap in folded-down position with an edge thereof extending over said narrow portion of the cover sheet.

15. A reusable pressure-sensitive writing board of the type having cover sheet means overlying a background, initially loosely, adapted to cling to the background where impressed thereon and to then show, until reloosened, a contrast between the clinging area and the nonclinging area, characterized by having its background formed of a sheet of cardboard having a clay-coated surface bearing a printed background with a pressure-tacky surface.

16. A reusable pressure-sensitive writing board according to claim 15 in which the printed background is printed as a multiplicity of dots in half-tone printing whereby color process printing can be used.

* * * * *

UNITED STATES PATENT AND TRADEMARK OFFICE

CERTIFICATE OF CORRECTION

PATENT NO. : 4,051,609

DATED : October 4, 1977

INVENTOR(S) : Thomas P. Boursaw

It is certified that error appears in the above-identified patent and that said Letters Patent are hereby corrected as shown below:

| | |
|---|---|
| Col. 1, l. 7 | "resuable" should be --reusable-- |
| Col. 2, l. 15 | delete "the" before "windows" |
| Col. 2, l. 29 | insert "below" before "each" |
| Col. 5, l. 28 | delete "the" before "head" |
| Col. 7, l. 38 | Delete the period (.) after "mils" |
| Col. 9, ls. 9 and 10 | "ahering" should be --adhering-- |
| Col. 9, l. 35 | "be" should be --lie-- |
| Col. 9, l. 48 | "thereof" should be --thereon-- |
| Col. 9, l. 53 | "for", first occurrence, should be --the-- |
| Col. 11, l. 19 | after "flap" insert --to face-- |

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*